United States Patent [19]

Slappey, Jr.

[11] Patent Number: 4,700,500

[45] Date of Patent: Oct. 20, 1987

[54] FIELD STRIPPING KEY PUNCH

[76] Inventor: L. Marvin Slappey, Jr., 416 W. Lamar St., Box 744, Americus, Ga. 31709

[21] Appl. No.: 794,005

[22] Filed: Nov. 1, 1985

[51] Int. Cl.[4] ..... F41C 27/00

[52] U.S. Cl. ..... 42/90; 81/3.05; 81/44

[58] Field of Search ..... 42/90, 1 R; 81/305, 81/44, 177.1, 177.3, 177.5; 30/164.5, 164.6, 164.7, 400, 443, 358, 366

[56] References Cited

U.S. PATENT DOCUMENTS 236,692 1/1881 Peakman ..... 81/177.1

1,020,589 3/1912 Wickman ..... 30/400

1,793,378 2/1931 Smith ..... 30/164.6

3,564,950 2/1951 Jorczak et al. ..... 42/106

*Primary Examiner*—Charles T. Jordan

[57] ABSTRACT

A tool designed to engage a substantial concave surface of the retaining pins in the receivers of Remington shotgun models 1100, 11-48, 878, 870, S-58 and 12; Remington rifles models 742, 552, 760 and 42; Sears Shotgun models XL 200 and M300, Winchester shotgun models 1400 and 120, Smith & Wesson shotgun model 1000 and Franchi model 48AL shotguns, to exert a substantial, sufficient dislodging force on the retaining pins to cause removal of said retaining pins from said receiver upon the application of a linear, pushing moment to said tool.

1 Claim, 7 Drawing Figures

FIELD STRIPPING KEY PUNCH

BACKGROUND OF THE INVENTION

The trigger plate assembly of an auto-loading or repeating shotgun or rifle may become obstructed and fail to function properly due to a loose primer, lodged shell, or debris lodged in the action. The tool of the present invention is designed to be available for use instantly, thus eliminating any time-consuming tool assembly or inconvenient transporting of the firearm to a workshop for diassembly. Further, the tool is designed to engage a substantial concave surface of the retaining pins and to exert a substantial dislodging force on the retaining pins upon the application of a linear pushing moment to the field stripping key punch. The inherent, mechanical design of the tool generates the substantial, dislodging force upon application of the linear, pushing moment.

Previously, the retaining pins of the trigger plate assembly of an auto-loading or repeating rifle or shotgun have been dislodged from the receiver with a conventional punch tool. This time consuming procedure has usually been performed in a workshop, whereas the tool described hereinafter is capable of quickly providing a linear force sufficient to dislodge the retaining pins from the receiver in the field thus eliminating the trip to the workshop.

BRIEF SUMMARY OF THE INVENTION

An object of this invention is to provide a key shaped punch tool, the tapered end of the longest leg of which can be readily placed against the concave heads of the retaining pins that hold in place the trigger plate assembly of Remington shotgun models 1100, 11–48, 878, 870, S-58 and 12; Remington rifle models 742, 552, 760 and 42; Sears shotgun models XL 300 and M300, Winchester shotgun models 1400 and 120, Smith and Wesson shotgun model 1000 and Franchi model 48AL shotguns, thereby, through the inherent mechanical design of said tool, permitting a sufficient, linear force to be exerted upon said retaining pins causing them to be dislodged, thus effecting the removal of the malfunctioning trigger plate assembly of said specified firearms, the tool being designed for attachment to a standard key ring or key chain.

DESCRIPTION OF THE PREFERRED EMBODIMENT

Figure 1C:
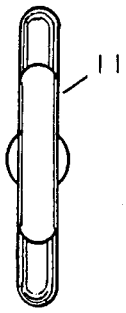
FIGS. 1B, 1C, and 1D are top, rear, and front views, respectively, of the invention illustrated in FIG. 1A.
Figure 1A:
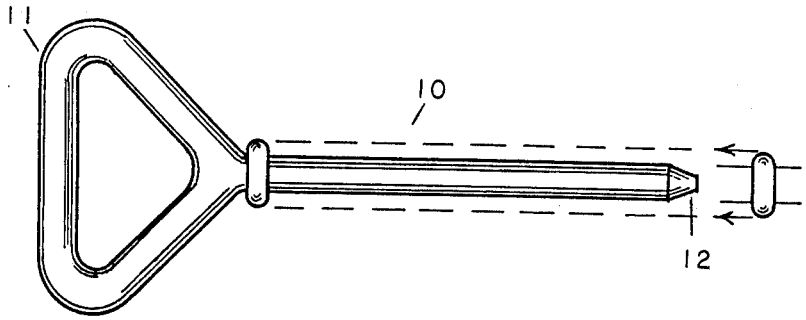
FIG. 1A is a side view of the preferred embodiment of the invention.
Figure 1D:
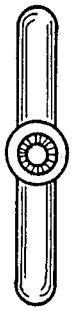
Figure 1B:
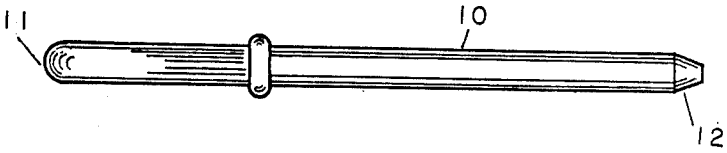

Referring more particularly to the drawings, FIGS. 1A–1D illustrated a key shaped punch tool 10 having first, second and third legs made of ⅛" rounded stock, also having a fourth leg made of ⅛" half-rounded stock, the first leg being substantially longer than the other three legs. The first leg has a tapered, nonjoining end 12. The end 12 is adapted to engage the concave ends 4A, 5A of the retaining pins 4, 5 that are lodged in place to hold the trigger plate assembly 3 in the receiver 2 of an auto-loading or repeating shotgun, or rifle 13. The opposite end of the first leg joining with the second and third legs at the point of juncture of the second leg with the third leg, the first leg defining angles of approximately 135° at its juncture with both the second leg and the third leg, the second and third legs defining an angle of approximately 45°. at the point of juncture of the second leg with the third leg. At the point of juncture of the second leg and the third leg with the fourth leg, angles of 45° are also formed. The second, third and fourth legs join to form an isometric, triangular configuration, said configuration forming a handle 11, said fourth leg having a continuous rounded inner face and a continuous flat outer face adapted to receive a linear force applied in the direction of tapered, non-joining end 12 of the first leg.

Figure 2:
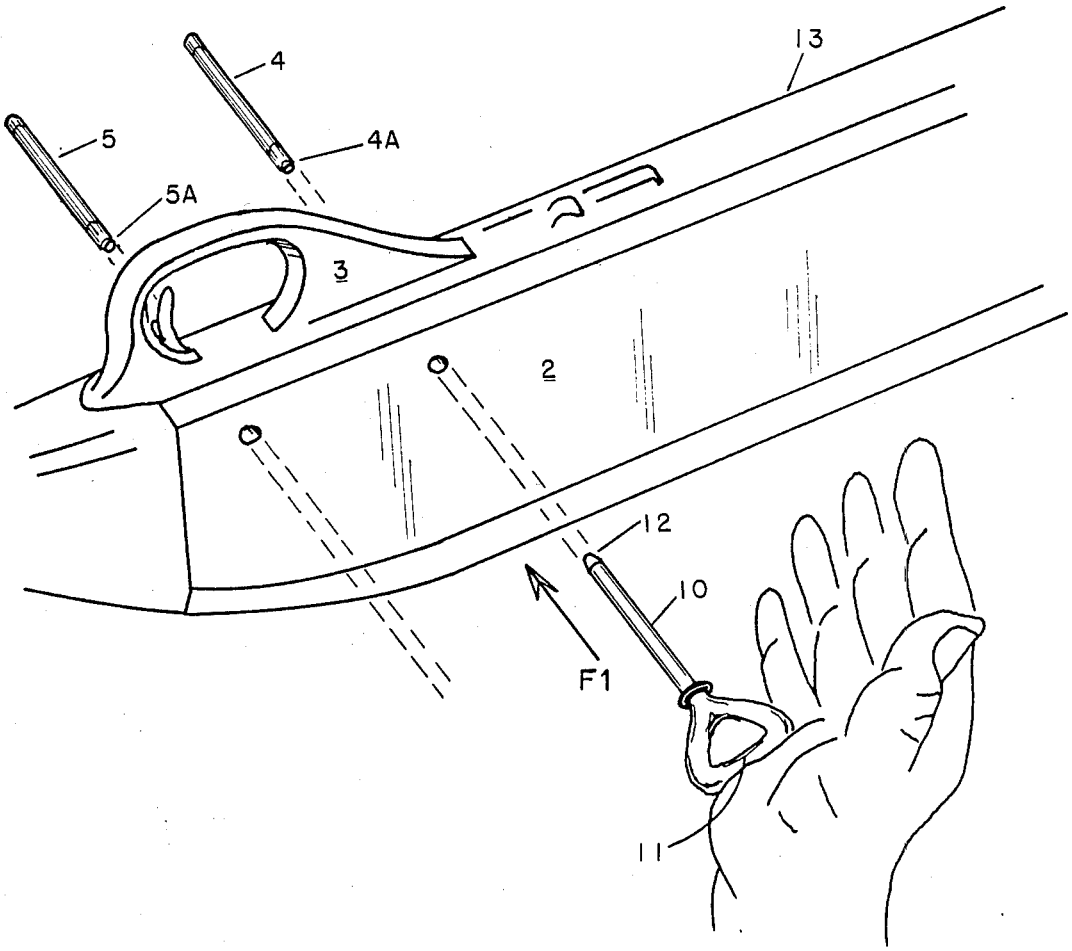
FIG. 2 is a perspective view of an auto-loading or repeating firearm showing the projected path of the punch tool to engage and dislodge the retaining pins from the receiver of the firearm.

A firearm 13 of the type intended for use with the tool 10 is shown generally in FIG. 2. Firearm 13 is shown to have a trigger plate assembly 3 held in place by retaining pins 4 and 5 within the receiver 2. Tapered end 12 of tool 10 engages a substantial surface of the concave ends 4A and 5A of retaining pins 4 and 5. When a linear force is applied to the triangular handle 11 in the direction indicated by the arrow F1, a moment is created upon the concave ends 4A and 5A of retaining pins 4 and 5. This moment is balanced by the resistance of retaining pins 4 and 5 to removal; however, a high level force is generated through the triangular handle 11 so that the maximum resistance of the retaining pins 4 and 5 may be easily overcome. Once dislodged, the retaining pins can be quickly removed by continued application of a linear force to the handle 11 in the direction indicated by the arrow F1.

Figure 3:
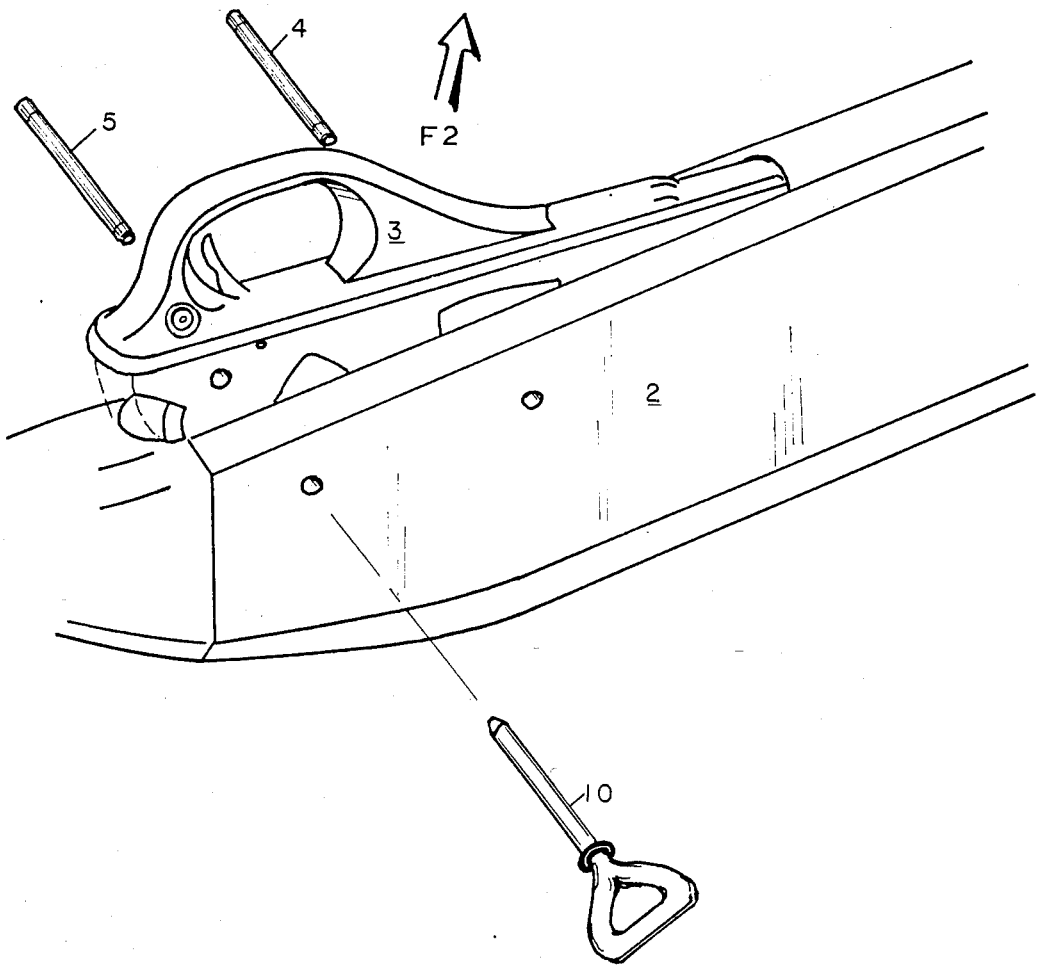
FIG. 3 is a perspective view of an auto-loading or repeating firearm showing the key punch, the dislodged retaining pins, and the projected path of removal of the trigger plate assembly.

The dislodged retaining pins 4 and 5 are shown in FIG. 3. The trigger plate assembly 3 is shown in a partially disengaged position, having been lifted out of the receiver 3 with a force applied in the direction of the arrow F2.

Figure 4:
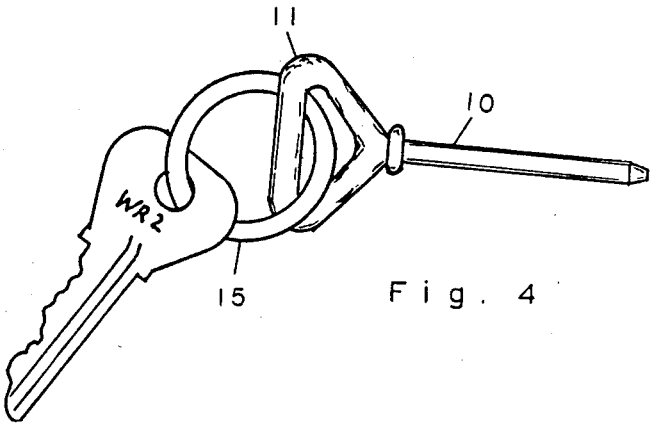
FIG. 4 is a view of the key punch tool attached to a standard key ring.

To store tool 10 simply attach handle 11 to standard key ring 15 as shown in FIG. 4.

What I claim is:

1. A key-shaped punch tool attachable to a standard key ring and adapted to push out retaining pins that hold in place a trigger plate assembly in a firearm receiver, comprising:

(a) a member having four legs;

(b) a first leg thereof being substantially longer than the other three and having at one end thereof a tapered portion for engaging a substantial surface of the ends of said retaining pins lodged in said firearm receiver;

(c) said legs being joined together at juncture points, said first leg joining with said second and third legs at the juncture point thereof and defining angles of approximately 135° at its juncture with both said second leg and said third leg; said second and third legs define an angle of approximately 45° at their juncture, and said second and fourth legs and said third and fourth legs also define angles of approximately 45° at their junctures;

(d) said second, third and fourth legs forming an isometric, triangular configuration, said configuration forming a handle joined to said first leg to enable said first leg to push out said retaining pins from said receiver when a linear force is exerted on said handle;

(e) said first, second, and third legs being made of $\frac{1}{8}$ inch rounded stock material, and said fourth leg being made of $\frac{1}{8}$ inch half-rounded stock material; and (f) said fourth leg having a continuous flat outer face and a continuous rounded inner face.

* * * * *